United States Patent [19]

Zakrajsek

[11] 4,034,849

[45] July 12, 1977

[54] WATCH CASE FOR PROTECTING AND DISPLAYING A WATCH

[75] Inventor: Jerome A. Zakrajsek, Fredonia, Wis.

[73] Assignee: Frank Mayer & Associates, Inc., Grafton, Wis.

[21] Appl. No.: 704,545

[22] Filed: July 12, 1977

[51] Int. Cl.[2] ..... B65D 5/50; B65D 85/40

[52] U.S. Cl. ..... 206/45.15; 206/44.12; 206/45.18; 206/301; 206/566; D9/234; D9/236

[58] Field of Search ..... 206/45.15, 44.12, 45.13, 206/45.17, 45.18, 75, 301, 18, 76, 77.1; 24/16 PB; D9/222, 233, 230, 234, 236; D87/1 B

[56] References Cited

U.S. PATENT DOCUMENTS

| | | | |
|---|---|---|---|
| 2,118,507 | 5/1938 | Guttman | 206/45.15 |
| 2,178,652 | 11/1939 | Shields | 206/75 |
| 2,199,008 | 4/1940 | Oshei | 206/45.15 |
| 2,575,016 | 11/1951 | Hopp et al. | 206/75 |
| 2,925,907 | 2/1960 | Grieve et al. | 206/75 |
| 3,005,541 | 10/1961 | Wisner | 206/45.13 |
| 3,669,300 | 6/1972 | Thomas | 206/45.15 |
| 3,930,577 | 1/1976 | Kortick | 206/45.18 |
| 3,973,292 | 8/1976 | Bonnet | 24/16 PB |
| D. 107,790 | 1/1938 | Parness et al. | D9/234 |
| D. 108,420 | 2/1938 | Braude | D9/234 |
| D. 226,586 | 3/1973 | Grube | D9/230 |

OTHER PUBLICATIONS

National Jeweler, 10/1936, p. 9.

*Primary Examiner*—Stephen P. Garbe
*Assistant Examiner*—Bruce H. Bernstein
*Attorney, Agent, or Firm*—James E. Nilles

[57] ABSTRACT

A watch case for storing and displaying a watch and including a base, a cover pivotably supported by the base for rotation from a storage position to a display position, and a cuff slideably releasably supported inside the cover and for supporting a watch. The pivotable cover is supported by pivot pins such that it is pivotable from a closed position, wherein the watch is received inside the base and protected, to an open position wherein the watch is attractively displayed. The cover includes a slide on its inside surface to provide a means for slideably supporting the watch supporting cuff so that the cuff and watch can be easily inserted into the cover or removed therefrom. The cuff comprises an elongated strip of flexible material which can be bent to form an oblong loop for supporting the watch. The cuff is flexible and includes means which permit adjustment of the size of the cuff so that watches having watch bands of a variety of sizes can be supported on the cuff.

7 Claims, 12 Drawing Figures

WATCH CASE FOR PROTECTING AND DISPLAYING A WATCH

BACKGROUND OF THE INVENTION

This invention generally relates to a wristwatch display case including a watch supporting cuff therein and for providing a durable packaging case as well as for providing an attractive retail display device.

It is desirable that watch cases of this type be functional to provide a protective case for a watch stored therein and also provide an attractive unit so that the watch can be displayed in the watch case for retail sale. It is also desirable that the watch case be capable of accommodating a wide variety of watches and include means for supporting watches having a variety of types and sizes of watch bands. It is further desirable that the watch case be easily accessible and provide a convenient means for inserting the watch into the watch case.

SUMMARY OF THE INVENTION

The watch case of the present invention provides an attractive watch case which includes a pivotable watch supporting cover such that the watch can be securely stored and can be displayed for sale by simply pivoting the cover from a storage position to a merchandise display position and can accommodate watches which have any style of watch band and regardless of whether the watch is small or large.

The watch case of the invention comprises a generally wedge-shaped supporting base and a wedge-shaped cover. The supporting base may be comprised of a one piece molded plastic unit which includes side walls, and a rearwardly inclined top. The side walls and top define a cavity and the top includes a large central opening for receiving the cover. The cover is pivotably mounted within the opening by a pair of pivot pins which project from its opposite sides and which are positioned generally at its midpoint but spaced from a horizontal axis through its center of gravity. The cover is rotatable within the opening from a storage position wherein the base and cover comprise a closed polyhedron to an open position wherein the cover is oriented generally vertically and the inside surface of the cover faces forwardly. The inside of the cover includes a slide or track for removably supporting a cuff which in turn provides support for a watch. The cuff comprises an elongated flexible plastic strip which can be bent to form an oblong loop for supporting a watch. The opposite ends of the flexible strip comprising the cuff include notches whereby the ends can be mutually secured together.

An advantage of the watch case of the invention is that it has an attractive generally wedge shaped polygonal configuration when closed and also presents an attractive configuration when opened to a display position.

An additional advantage of the present invention is that the cuff is constructed such that its size can be adjusted so that it can support any type or style of watch band including buckled leather bands, expandable bands, or link bands including an overcenter locking type securing means. Furthermore, the cuff can accommodate bands of varied sizes.

A further advantage of the present invention is that the cuff is slideably supported by the cover in such a manner that the cuff is easily inserted into the cover during manufacturing and also easily removed for inspection and the like.

The pivot pins supporting the cover are positioned with respect to the cover such that when a watch is attached to the cover, the weight of the watch and cover prevent rotation of the cover to an open position. A latch means is also provided to releasably support the cover in its display position.

Other advantages of the watch case of the invention will become apparent from the following description of a preferred embodiment and from the drawings.

DESCRIPTION OF THE PREFERRED EMBODIMENT

Figure 1:
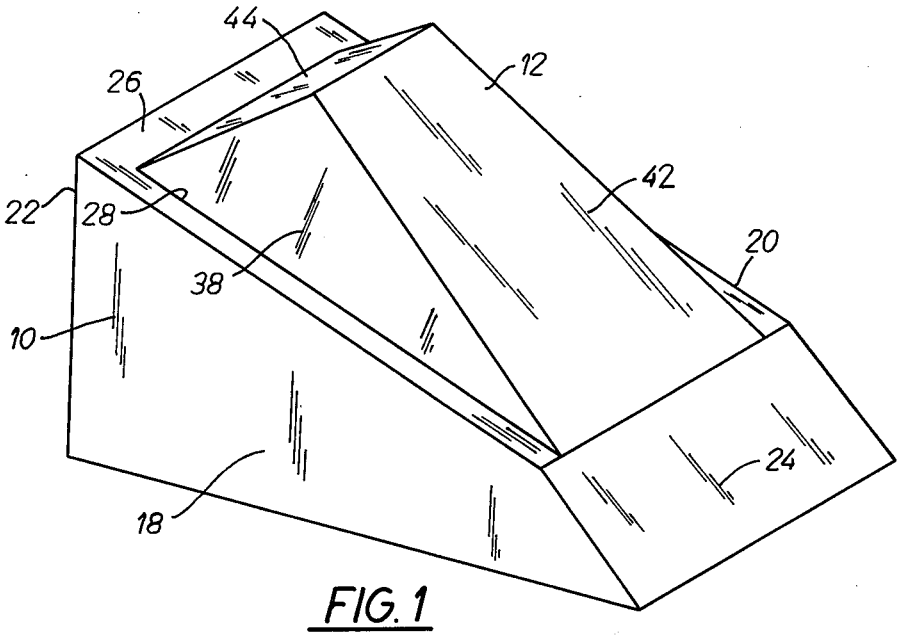
FIG. 1 is a perspective view of the watch case of the invention with the cover shown in a closed position.

The watch case of the present invention generally includes a base 10 which pivotably supports a movable cover 12. The cover 12 includes a cavity 14 therein which houses a resilient flexible cuff 16 for supporting a watch W.

The base 10 is generally flat on the bottom so that it can rest on a supporting surface and includes a pair of generally triangular vertical side walls 18 and 20 as well as a vertical rear wall 22 joining the side walls 18 and 20. The base 10 is generally wedge shaped when viewed in side elevation and includes an inclined front wall 24 and an inclined top wall 26 each disposed between the side walls 18 and 20. The top wall 26 includes a rectangular opening 28 therethrough for receiving the cover 12 therein. The opposite sides of the opening 28 are defined by a pair of parallel side walls 32 which are spaced from the side walls 18 and 20 and which are intended to be received in closely adjacent relationship to the cover 12. The base 10 also includes a generally concave floor 34 connected at its forward end to the upper edge 36 of the front wall 24 and extending downwardly and rearwardly between the side walls 32. The base 10 can be comprised of a one-piece molded article constructed from a material such as polystyrene or the like.

The cover 12 similarly comprises a generally wedge-shaped one-piece molded article which can be constructed of a material such as polystyrene. The cover includes a pair of generally triangular side walls 38 and 40 which are joined by front and rear trapezoidal walls 42 and 44. The triangular side walls 38 and 40 each include downwardly extending generally parallel triangular extensions 46 and 48 which are intended to be receivable between the side walls 32. As best shown in FIGS. 3 through 5 and 7, the downwardly extending triangular extensions 46 and 48 each support an outwardly extending pivot pin 50 which provides a pivotable or trunnion support for the cover 12. The pins 50 are slideably received within generally vertical grooves 52 in the side walls 32 and can be received within the bores 54. The cover 12 is sufficiently flexible that its side walls 38 and 42 can be squeezed together to permit pins 50 to be received in bores 54.

Figure 2:
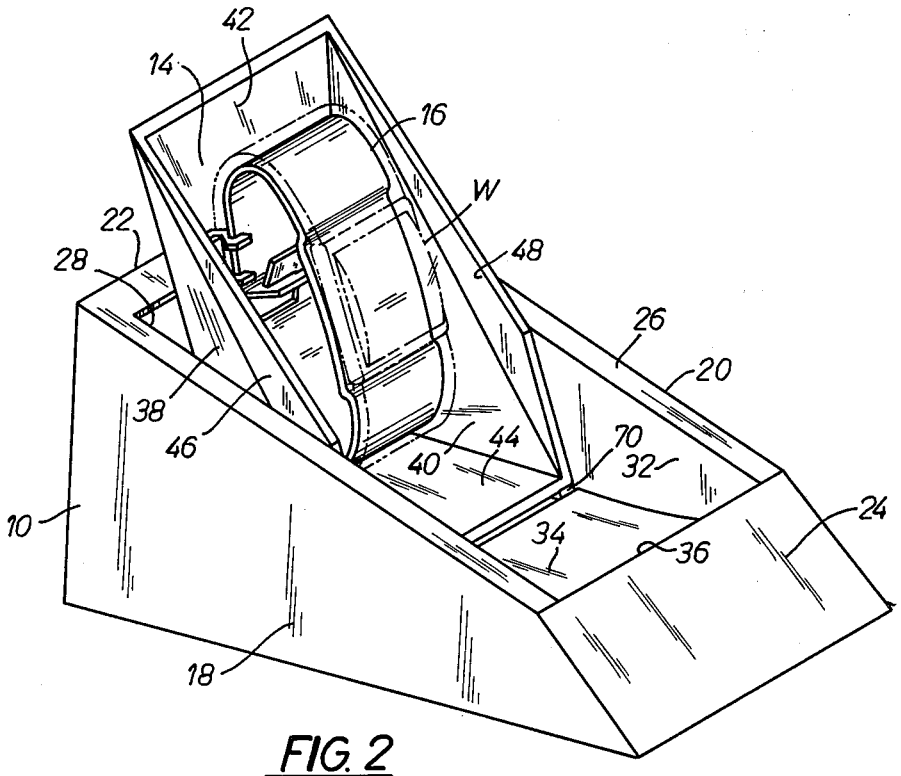
FIG. 2 is a perspective view of the watch case shown in FIG. 1 but with the cover in an open display position.
Figure 3:
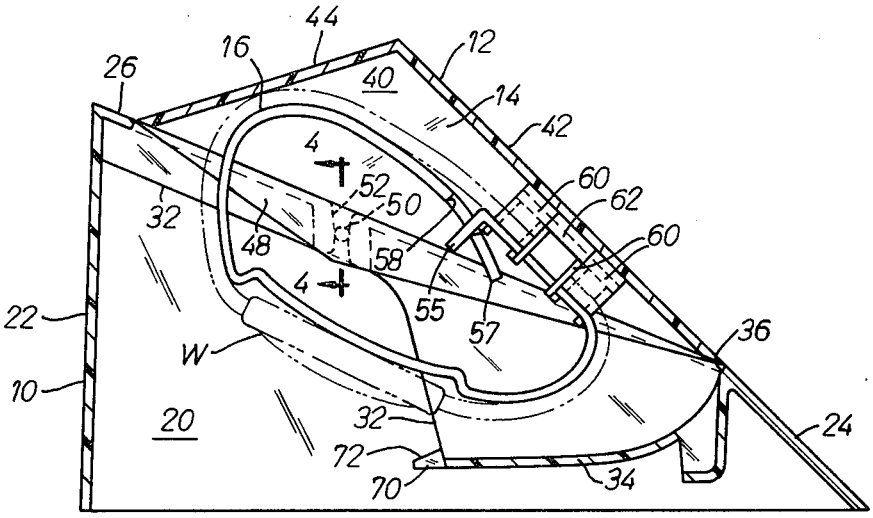
FIG. 3 is a cross-sectional side elevation view of the watch case shown in FIG. 1 wherein the cover is in the closed position.
Figure 5:
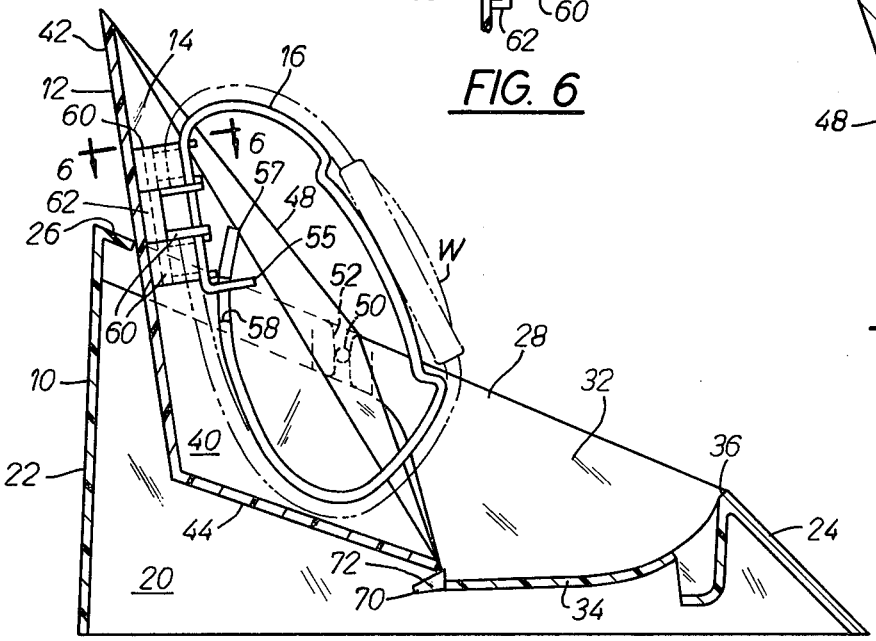
FIG. 5 is a view similar to FIG. 3 but showing the cover in an open display position.
Figure 7:
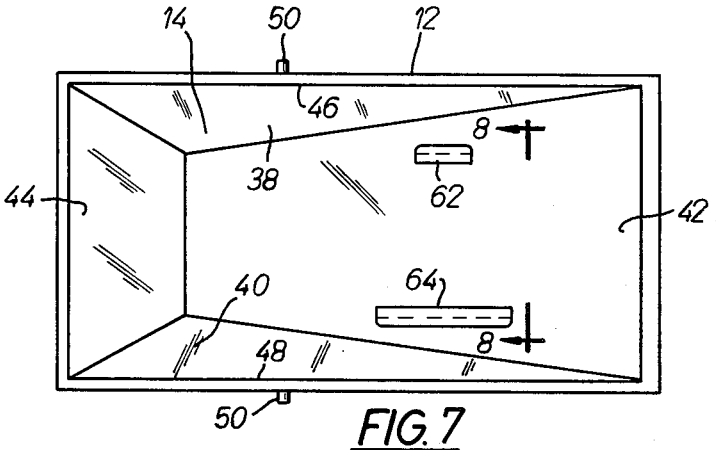
FIG. 7 is a view of the inside of the cover shown in FIGS. 1 and 2.
Figure 10:
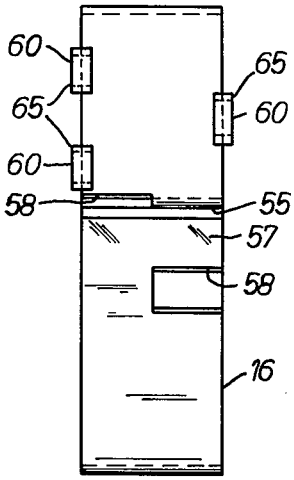
FIG. 10 is an elevation view taken along line 10—10 in FIG. 9.
Figure 9:
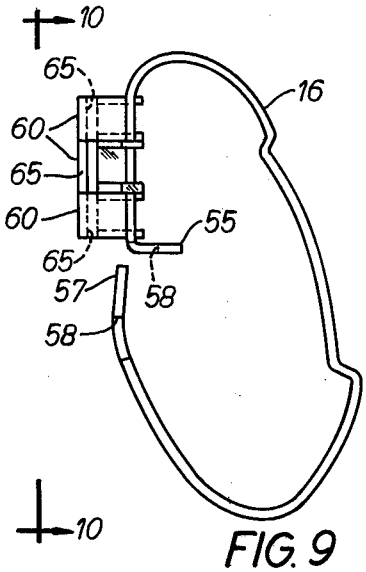
FIG. 9 is a side elevation view of a cuff shown in FIGS. 2, 3, and 5.
Figure 12:
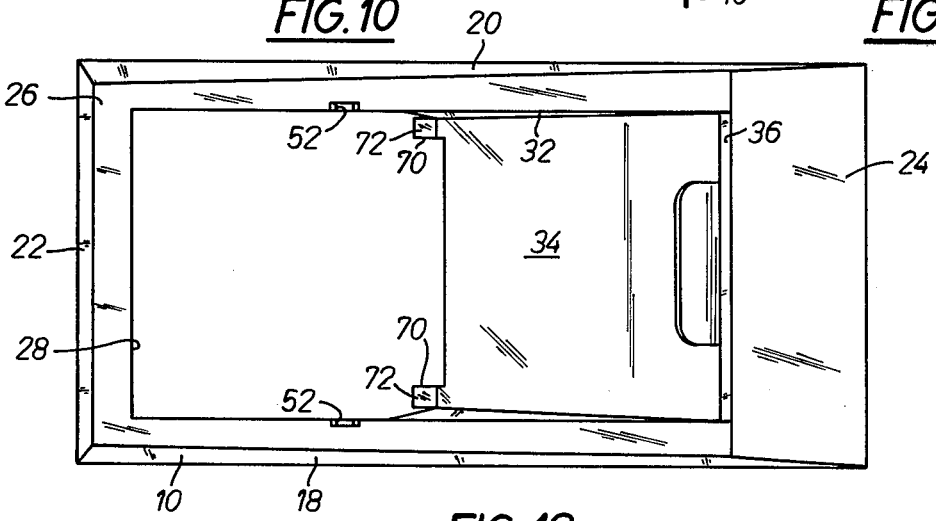
FIG. 12 is a plan view of the base of the watch case shown in FIGS. 1 through 3 and 5.

As previously stated, the cover 12 defines a cavity 14 for supporting a cuff 16 and a watch W. The cuff 16 is shown in FIGS. 9–10 and is generally comprised of an elongated strip of flexible material such as a plastic having sufficient rigidity that it is self-supporting in the shape of an oblong loop as shown in FIG. 9. The opposite ends 55 and 57 of the elongated strip comprising the cuff 16 include generally rectangular opposed notches 58 such that these ends can be hooked together. To further facilitate such a hooking together of the ends, the end 55 includes a right angular bend therein. The cuff 16 is shown in FIGS. 2, 3, and 5 with its opposite ends secured together. The cuff can also be mounted in the cover 12 in a more expanded state as shown in FIG. 9. When the cuff is expanded as shown in FIG. 9, it is functional to support a watch having a relatively large watch band and when the ends 55 and 57 are secured together, the cuff can accommodate a smaller watch band.

Figure 6:
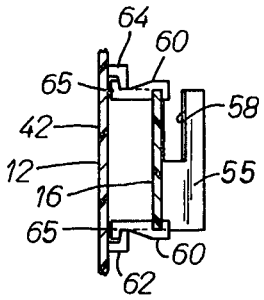
FIG. 6 is a cross-sectional view taken along line 6—6 in FIG. 5.
Figure 4:
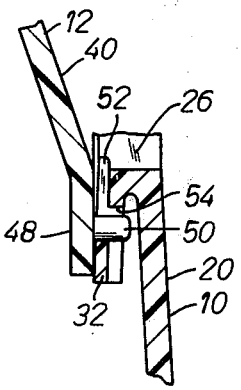
FIG. 4 is a cross-sectional view taken along line 4—4 of FIG. 3.
Figure 8:
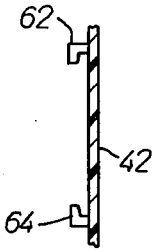
FIG. 8 is a cross-sectional view taken along line 8—8 in FIG. 7.
Figure 11:
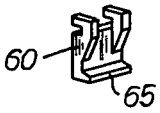
FIG. 11 is a perspective view of the cuff guides shown in FIGS. 9 and 10.

The cuff 16 also includes a plurality of guides 60 secured to opposite sides of the flexible strip comprising the cuff and functioning to permit it to be slideably supported inside the cover 12. As best shown in FIGS. 6 and 8, the cover 12 includes a slide comprised of a pair of tracks 62 and 64 for receiving the guides 60 of the cuff. The tracks 62 and 64 are secured to the inside surface of the trapezoidal wall 42 in parallel relation and spaced apart by a distance approximating the width of the strip comprising the cuff 16. As best shown in FIG. 6, outwardly projecting extensions 65 of the guides 60 are slideably received by the tracks 62 and 64 to secure the cuff 16 to the trapezoidal wall 42. During the manufacturing and packaging process the watch W can be slipped around the cuff 16 and the cuff and watch can then be slideably inserted into the cover 12. This process can be accomplished easier and faster than securing a watch around a cuff which is an integral part of the watch case. Furthermore, a subsequent inspection of the watch is facilitated since the watch and cuff can be easily slideably removed from the cover and replaced.

FIGS. 1 and 3 illustrate the watch case in a closed position. The center of gravity of the cover when it includes a watch therein is such that a horizontal line parallel to the pivot axis of the co-axial pins 50 is spaced substantially forwardly of the axis of the pivot pins 50. As a result of this design, the weight of the cover and the watch are sufficient to maintain the cover in a closed position and prevent the watch case from opening inadvertently. When it is desired to display the watch case, the cover 12 can be rotated upon the pivot pins 50 to the position shown in FIGS. 2 and 5 such that the watch is attractively displayed. The cover 12 is maintained in the position shown in FIGS. 2 and 5 by a pair of latch members 70 integrally connected to the rearward end of the concave floor 34. The latches 70 include a ramp surface 72 and can be depressed slightly downwardly by the leading edge of the cover 12 as the cover 12 is rotated to the open position.

I claim:

1. A watch case for storing and displaying a watch and comprising:

a base including a front side, a rear side, opposed spaced apart side walls and an upper surface supported between said side walls, said upper surface including an opening therein;

a cover pivotably supported within said opening and rotatable therein between a closed storage position and an open display position, said cover including a front edge, a rear edge, spaced apart sides and an inside surface defining a cavity, said front edge being disposed adjacent said front side of said base and supported by said base;

supporting means for pivotably supporting said cover for rotation within said opening, said supporting means including pivot pins extending between said sides of said cover and said side walls of said base;

latch means for releasably securing said cover in said open display position and comprising at least one ramp surface connected to said base within said opening below said upper surface, said ramp surface sloping upwardly toward said front side of said base and frictionally engageable with said front edge of said cover when the latter is rotated to said open display position;

a cuff for releasably supporting a watch; and means for releasably attaching said cuff to said inside surface of said cover whereby said cuff and a watch supported thereon are supported within said cavity and movable with said cover from a storage position to a display position.

2. The watch display case set forth in claim 1 wherein said means for releasably attaching said cuff to said inside surface includes a pair of parallel spaced apart tracks attached to said inside surface of said cover and a pair of guides secured to said cuff and slideably and releasably connected to said tracks.

3. The watch case set forth in claim 2 wherein said cuff comprises an elongated flexible band forming an expandable and contractable loop for supporting a watch thereon, said flexible band including opposite ends, and wherein each of said opposite ends include means for releasably securing said opposite ends together.

4. A watch case for storing and displaying a watch and comprising:

a base including a front side, a rear side, opposed spaced apart side walls and an upper surface supported between said side walls, said upper surface including an opening therein, and a floor within said opening extending rearwardly from said front side and supported between said side walls;

a cover pivotably supported within said opening and rotatable therein between a closed storage position and an open display position, said cover including a front edge, a rear edge, spaced apart sides and an inside surface defining a cavity, said front edge being disposed adjacent said front side of said base;

supporting means for pivotably supporting said cover for rotation within said opening, said supporting means including pivot pins projecting from said sides of said cover and pivotably supported by said side walls of said base;

latch means for releasably securing said cover in said open display position and comprising at least one ramp surface near the rearward edge of said floor and sloping upwardly toward said front side of said base and frictionally engageable with said front edge of said cover when the latter is rotated to said open display position;

a cuff for releasably supporting a watch; and means for releasably attaching said cuff to said inside surface of said cover whereby said cuff and a watch supported thereon are supported within said cavity and movable with said cover from a storage position to a display position.

5. The watch case set forth in claim 4 wherein said upper surface is inclined upwardly and rearwardly and said side walls of said base form a trapezium and wherein said cover comprises triangular sides.

6. The watch display case set forth in claim 4 wherein said means for releasably attaching said cuff to said inside surface includes a pair of parallel horizontally spaced apart tracks attached to said inside surface of said cover and a pair of guides secured to said cuff and slideably and releasably connected to said tracks.

7. A display case for storing and displaying an article and comprising:

a base having walls defining a recess therein, said base having front and rear sides;

a cover pivotally mounted on said base and pivotable about an axis between a closed storage position wherein it substantially overlies said recess and an open display position wherein it projects inwardly and outwardly of said recess, said cover having a cavity on the inside thereof, said cover having front and rear edges disposed toward said front and rear sides of said base, respectively;

first means on said base engaging said front edge of said cover to support said cover in said closed storage position;

second means on said base within said recess for releasably and frictionally engaging said rear edge of said cover to maintain said cover in open display position, said second means comprising at least one ramp surface which slopes upwardly toward said front side of said base;

and means on said cover for releasably securing said article in said cover when said cover is in either of said positions;

said cover and said means for releasably securing said article in said cover having a combined center of gravity, when said article is secured thereto, which lies between said axis and said front edge of said cover when said cover is in said closed storage position.

* * * * *